United States Patent [19]

Tokoro

[11] Patent Number: 4,785,774

[45] Date of Patent: Nov. 22, 1988

[54] PISTON FOR AN INTERNAL COMBUSTION ENGINE

[75] Inventor: Noriyuki Tokoro, Gotenba, Japan

[73] Assignee: Toyota Jidosha Kabushiki Kaisha, Toyota, Japan

[21] Appl. No.: 920,064

[22] Filed: Oct. 17, 1986

[30] Foreign Application Priority Data

Oct. 18, 1985 [JP] Japan ..... 60-158709

[51] Int. Cl.[4] ..... F02F 7/00

[52] U.S. Cl. ..... 123/193 P; 92/239

[58] Field of Search ..... 123/193 P; 92/237, 208, 92/239

[56] References Cited

U.S. PATENT DOCUMENTS

| | | | |
|---|---|---|---|
| 1,089,823 | 3/1914 | Windeler | 123/193 P |
| 1,386,144 | 8/1921 | Wall | 123/193 P |
| 1,432,799 | 10/1922 | Stackhouse | 123/193 P |
| 1,891,914 | 12/1932 | Butler | 92/239 |
| 2,120,090 | 6/1938 | Day | 92/239 |
| 2,177,574 | 10/1939 | Malina | 92/237 |
| 2,869,946 | 1/1959 | Herrmann | 92/237 |
| 2,990,226 | 6/1961 | Fangman | 92/239 |
| 3,000,676 | 9/1961 | Cheney et al. | 123/193 P |
| 3,187,643 | 6/1965 | Pope | 123/193 P |
| 3,906,924 | 9/1975 | Elsbett | 123/193 P |
| 4,013,057 | 3/1977 | Guenther | 123/193 P |
| 4,073,220 | 2/1978 | Guenther | 123/193 P |
| 4,274,372 | 6/1981 | Kelm et al. | 92/239 |
| 4,338,858 | 7/1982 | Reitz | 92/239 |
| 4,466,399 | 8/1984 | Hinz et al. | 123/193 P |
| 4,494,501 | 1/1985 | Ludovico | 123/193 P |
| 4,506,632 | 3/1985 | Kanda et al. | 123/193 P |
| 4,544,299 | 10/1985 | Danckert | 123/193 P |
| 4,702,151 | 10/1987 | Munro et al. | 92/239 |

FOREIGN PATENT DOCUMENTS 58-32150 2/1983 Japan .

*Primary Examiner*—Charles J. Myhre
*Assistant Examiner*—David A. Okonsky
*Attorney, Agent, or Firm*—Cushman, Darby & Cushman

[57] ABSTRACT

A piston for an internal combustion engine including a crown, a skirt and bosses. The skirt has a circumferentially extending faucet rib in a lower portion of the skirt and reinforcing ribs which extend in a thrust and thrust-opposing direction of the piston from the bosses straight to the faucet rib. Reinforcing ribs increase the rigidity of piston in the thrust and thrust-opposing direction and suppress parmanent deformation of the skirt in the thrust and thrust-opposing direction, resulting in decreasing slapping sounds in a piston and cylinder structure without sticking of a piston with a cylinder bore.

9 Claims, 4 Drawing Sheets

PISTON FOR AN INTERNAL COMBUSTION ENGINE

BACKGROUND OF THE INVENTION

The present invention relates to a piston for an internal combustion engine, and more specifically relates to a piston where deformation of the skirt in a thrust and thrust-opposing direction of the piston is suppressed.

The structure of a piston of a prior art is shown in FIGS. 7 and 8. As shown in FIGS. 7 and 8, a piston 1 is constructed of aluminum alloy for the purpose of weight reduction. Piston 1 includes a crown 2 and a skirt 3. A pair of bosses 4 are formed at an axial mid-portion of skirt 3 and a piston-pin 5 is inserted in bosses 4 and extend over the paired bosses 4. A connecting rod 6 is rotatably coupled with piston-pin 5. Piston-ring grooves 7 are formed in a radially outer portion of crown 2 and the lowermost groove functions as an oil-ring groove 8. A recess means 9 is formed in a upper portion of crown 2 and recess means 9 constitutes one portion of a combustion chamber of the internal combustion engine.

A radially outer portion of crown 2 where piston-ring grooves 7 are formed constitutes a ring-land 10. The diameter of the outer surface of ring-land 10 is formed slightly smaller than that of skirt 3 to prevent stick with a cylinder bore because ring-land 10 is located near to the combustion chamber and becomes hotter than skirt 3 resulting in larger thermal expansion than skirt 3. Since portions **3*b* of skirt 3 where bosses 4 are located receive a large amount of heat conduction and become at high temperatures, the portions 3*b* of skirt 3 expand to a greater extent than portions 3*a* of skirt 3 which are located at positions offset circumferentially by 90 degrees from portions 3*b*. To prevent stick with the cylinder bore, a distance between the outside surfaces of the opposed portions 3*b* are constructed smaller than a distance between the outside surfaces of the opposed portions 3*a***.

When piston 1 having the above-mentioned structure is slidably inserted in the cylinder bore and is rotatably coupled with connecting rod 6, piston 1 pivots around the axis of bosses 4 in a direction perpendicular with the axis of bosses 4 according to the swinging motion of connecting rod 6. Portions **3*a* of skirt 3 which are on sides perpendicular with the axis of bosses 4 and are opposed to each other mainly contact the cylinder bore and receive thrust and thrust-opposing forces from the cylinder bore whereby the orientation of piston 1 is kept. It is very important to maintain a clearance between the inside surface of the cylinder bore and the portions 3*a* of skirt 3 which are on thrust and thrust-opposing sides of piston 1, that is, which are on sides adjacent to the A-A axis of piston 1 in FIG. 8. This clearance is very important in maintaining the posture of piston 1 and must be set at an appropriate value. If the clearance is too small, skirt 3 would bind as it expands thermally. If the clearance is too large, slapping sounds would occur during the reciprocating motion of piston 1** and sounds in a car room would be increased.

Further, slits 11 are formed in piston 1 on the thrust and thrust-opposing sides of oil-ring groove 8. Slits 11 extend from the thrust and thrust-opposing portions of piston 1 toward the portions of piston 1 which are circumferentially offset by 90 degrees from the thrust and thrust-opposing portions of piston 1. In such a piston having slits 11, the portions of ring-land 10 which are located above bosses 4 produce a large thermal expansion because there are no slits above bosses 4 and therefore, heat can conduct from crown 2 to bosses 4 and because the amount of heat conduction is large due to the large heat capacity of bosses 4. To suppress the thermal expansion of the thrust and thrust-opposing sides of piston 1, struts 12 which circumferentially extend from the portions offset by 90 degrees from the thrust and thrust-opposing sides including bosses 4 toward the thrust and thrust opposing sides of piston 1 are provided in a radially inner portion of piston 1. Struts 12 are constructed of a metal which has smaller thermal expansion characteristics than an aluminum alloy. In such a manner thermal expansion of piston 1 is suppressed.

However, when piston 1 having slits 11 and struts 12 reciprocates in the cylinder bore and an inertia force acts on piston 1, piston-pin 5 elastically deforms such that both end portions of piston-pin 5 are bent upward with respect to the axial center portion of piston-pin 5 where piston-pin 5 is connected with the connection rod. Due to the deformation of piston-pin 5, the opposed portions of skirt 3 where bosses 4 are located deform radially outside at the lower portions thereof and the diameter of the opposed portion is increased while the diameter of the thrust and thrust-opposing sides of skirt 3 is decreased which will produce slapping sounds. Such a deformation of skirt 3 easily occurs especially in piston 1 having slits 11, because the upper portions of the thrust and thrust-opposing sides of skirt 3 is not restricted due to slits 11 and skirt 3 can easily deform. Repetition of such a deformation produces a permanent deformation of skirt 3 in such an order that a permanent radial deformation of about 50 micron will occur after one hundred hours test. Therefore, suppression of deformation of skirt 3 has been strongly desired.

Japanese Utility Model Publication SHO No. 58-32150 discloses ribs for suppressing deformation of a skirt. The rib disclosed in the publication is a rib bent in the form of an arc along a circumferentially extending inside surface of the skirt and has little rigidity in the thrust and thrust-opposing direction of the piston. Therefore, the rib has little effect in suppressing a deformation of the skirt in the thrust and thrust-opposing direction of the piston. Additionally, since the rib is provided at an axial mid-portion of the skirt, the rib would increase a radially inward deformation of the lower portion of the skirt when the upper portion of the skirt expands radially outward, because ribs would function as a fixed point of the deformation. Therefore, provision of such a rib would increase slapping sounds.

SUMMARY OF THE INVENTION

An object of the present invention is to suppress a deformation of a skirt in the thrust and thrust-opposing direction which is caused by the inertial force of a piston having slits and struts, thereby reducing slapping sounds during reciprocating motion of the piston.

The above object is attained by a piston for an internal combustion engine according to the present invention. The piston comprises: (a) a crown having a circumferentially extending oil-ring groove in an outer portion of the crown, the oil-ring groove having slits on thrust and thrust-opposing sides of the piston, (b) a skirt integrally connected to the crown and extending downward, the skirt having a circumferentially extending faucet rib on an inside surface of a lower portion of the skirt and being provided with struts in a upper portion of the skirt, the struts extending from one of the thrust and thrust-opposing sides of the piston to the other, (c) bosses protruding inward from an inside surface of the piston and extending in a direction perpendicular with a thrust and thrust-opposing direction of the piston, the bosses being opposed to each other, and (d) reinforcing ribs formed on the inside surface of the piston and protruding inward from the inside surface of the piston, the reinforcing ribs extending straight in the thrust and thrust-opposing direction of the piston from the faucet rib to the bosses.

In the piston thus constructed, the thrust and thrust-opposing sides of the skirt are supported by not only the wall of the skirt itself but also the reinforcing ribs and any deformation in the thrust and thrust-opposing direction is suppressed. Since the reinforcing ribs extend straightly in the thrust and thrust-opposing direction of the piston and does not yield a circumferential bending deformation, the rigidity of the reinforcing ribs is very high in the thrust and thrust-opposing direction of the piston and can effectively function as a reinforcing member. Additionally, since the reinforcing ribs are connected to the faucet rib of the lower portion of the skirt, the rahmen frame including the reinforcing ribs and the faucet rib effectively reinforces the membrane structure of the cylindrical skirt. Further, since the skirt is supported by the rahmen frame at the lower portion of the skirt which would produce a largest deformation if there were no rahmen structure, the suppression of deformation of the skirt is most effective.

BRIEF DESCRIPTION OF THE DRAWINGS

These and other objects and advantages of the present invention will become more apparent and more readily appreciated from the following detailed description of the presently preferred exemplary embodiment of the invention taken in conjunction with the accompanying drawings, of which.

DETAILED DESCRIPTION OF THE PREFERRED EMBODIMENT

Figure 1:
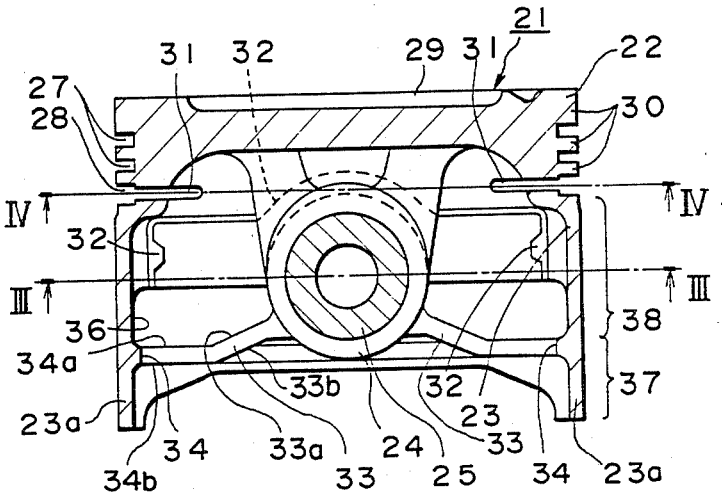
FIG. 1 is a sectional view of a piston for an internal combustion engine according to the present invention.

FIGS. 1 to 5 show an embodiment of the present invention. In FIGS. 1 to 5, a piston 21 for an internal combustion engine comprises a crown 22 provided at a top of piston 21, a skirt 23 connected to crown 22 and extending downward from crown 22, two bosses 24 protruding inward from an inside surface 36 of piston 21 and being opposed to each other, and reinforcing ribs 33 formed on inside surface 36 of piston 21. Piston 21 excluding struts 32 (later described) is constructed of aluminum alloy.

Figure 2:
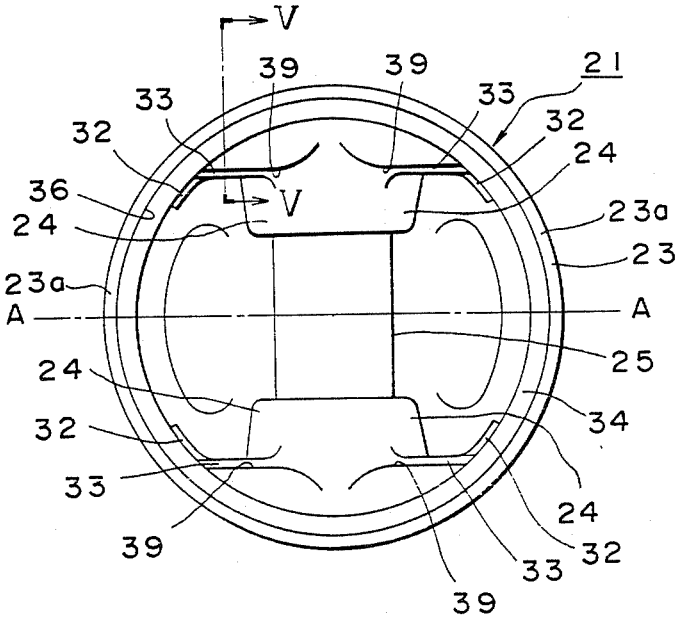
FIG. 2 is a bottom view of the piston of FIG. 1.
Figure 3:
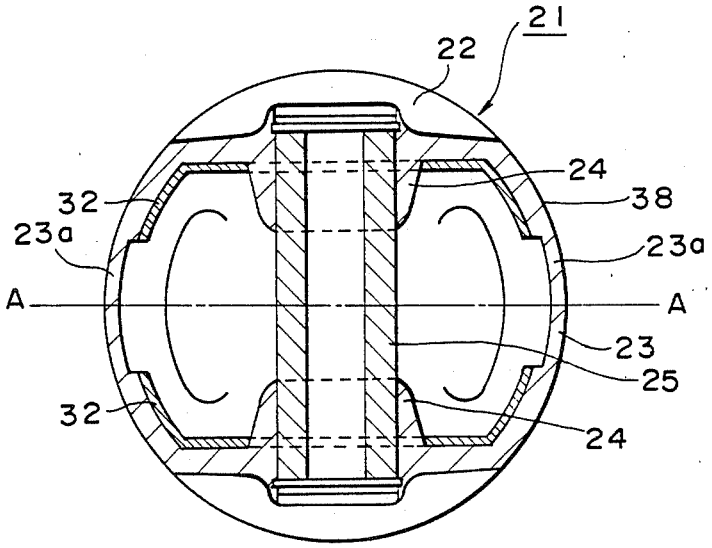
FIG. 3 is a sectional view taken along line III—III of FIG. 1.
Figure 4:
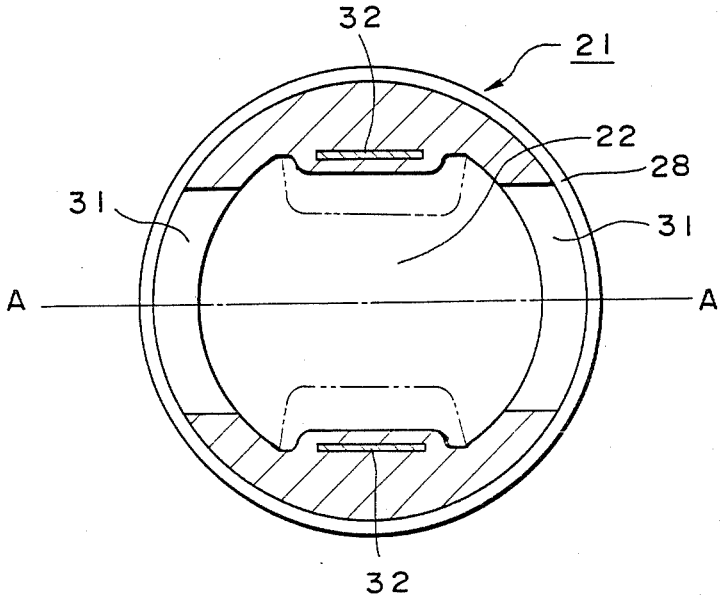
FIG. 4 is a sectional view taken along line IV—IV of FIG. 1.

Crown 22 has a substantially circular outside surface. Crown 22 has a plurality of circumferentially extending piston-ring grooves 27 in a radially outer portion of crown 22 which constitutes a ring-land 30. The lowermost groove is an oil-ring groove 28. Oil-ring groove 28 has slits 31 on thrust and thrust-opposing sides of piston 21. Slits 31 are opposed to each other. Slits 31 radially penetrate piston 21 and extend in a circumferential direction of piston 21 from the thrust and thrust-opposing sides of piston 21 toward portions circumferentially offset by 90 degrees from the thrust and thrust-opposing direction of piston 21. Crown 22 has a recess 29 which constitutes one portion of a combustion chamber of the internal combustion engine. In FIGS. 2 to 4, line A-A shows a thrust and thrust-opposing direction of piston 21.

Skirt 23 has a lower portion 37 which is substantially cylindrical and a portion 38 excluding lower portion 37 which has substantially cylindrical inner surface on the thrust and thrust-opposing sides of piston 21 and has a substantially flat inner surface on sides perpendicular with the thrust and thrust-opposing direction of piston 21. The outside diameter of the cylindrical portions of skirt 23 is slightly larger than that of crown 22. Skirt 23 has a circumferentially extending faucet rib 34 on an inside surface of lower portion 37 of skirt 23. Faucet rib 34 which is inevitably formed in a production stage extends over an entire circumference of skirt 23 and protrudes radially inward from the inside surface of skirt 23. Skirt 23 is provided with struts 32 in a upper portion of skirt 23. Struts 32 extends from one of the thrust and thrust-opposing sides of piston 21 to the other of the thrust and thrust-opposing sides of piston 21. Struts 32 are bent in an axially upward direction at their longitudinal central portions to prevent struts 32 from interfering with piston-pin 25. Struts 32 are constructed of a metal having a thermal expansion coefficient smaller than that of aluminum alloy.

Bosses 24 extend in the direction perpendicular with the thrust and thrust-opposing direction of piston 21 and are opposed to each other. End portions of a piston-pin 25 are rotatably inserted into holes formed in bosses 24 and the substantially flat portions of skirt 23. A connecting rod (not shown) is rotatably coupled with a axial mid-portion of piston-pin 25 and therefore, piston 21 can rotate around an axis of piston-pin 25 in the thrust and thrust-opposing direction.

Figure 5:
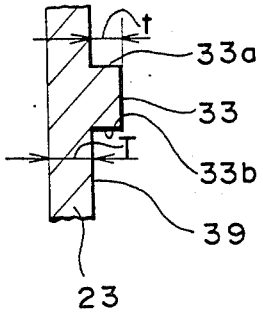
FIG. 5 is a sectional view taken along line V—V of FIG. 2.

Reinforcing ribs 33 are integrally formed on inside surface 36 of piston 21 and protrude inward from inside surface 36 of piston 21. Reinforcing ribs 33 are integrally formed on inside surfaces 39 of the flat portions of skirt 23. Reinforcing ribs 33 extend substantially straight in the thrust and thrust-opposing direction of piston 21 and obliquely upward from faucet rib 34 to bosses 24. Reinforcing ribs 33 are provided on both sides of each of two bosses 24 and are symmetrical to each other with respect to the axis of bosses 24. Reinforcing ribs 33 are connected to faucet rib 34 such that upper surfaces 33*a* and lower surfaces 33*b* of reinforcing ribs 33 join a upper surface 34*a* and a lower surface 34*b* of faucet rib 34, respectively. Reinforcing ribs 33 have a substantially constant height and a substantially constant width through the entire length of each reinforcing rib 33. As shown in FIG. 5, a height t (see FIG. 5) of reinforcing rib 33 in the inward direction of piston 21 is not less than one third of a thickness T of the substantially flat portions of skirt 23.

Next, behaviors of piston 21 having the above-mentioned structure will be explained.

Since a connecting rod mutually swings around the axis of piston-pin 25, piston 21 intends to rotate around the axis of piston-pin 25. However, the thrust and thrust-opposing sides of piston 21 receive thrust and thrust-opposing reaction forces from the cylinder bore to maintain the orientation of piston 21. Thrust and thrust-opposing sides 23*a* of skirt 23 receive the reaction forces from the cylinder bore and intend to deform inward in the thrust and thrust-opposing direction of piston 21. Repetition of loading of the reaction forces results in a permanent inward deformation of thrust and thrust-opposing sides 23*a* of skirt 23. The permanent deformation would be of the order of about 50 micron or more, if there were no reinforcing ribs in a piston, and the permanent deformation would cause slapping sounds in a piston and cylinder structure. Though there is a faucet rib, mere provision of the faucet rib is not effective for suppressing the permanent deformation, because the faucet rib extend circumferentially and can not bear a large force in a thrust and thrust-opposing direction of a piston.

However, in piston 21 of the present invention, since faucet rib 34 is supported by reinforcing ribs 33, the skirt supporting effects are increased to a great extent. Since an arc length of faucet rib 34 between the supporting portions of reinforcing ribs 33 is short, the thrust and thrust-opposing sides of faucet rib 34 become rigid. Further, since reinforcing ribs 33 extend in the thrust and thrust-opposing direction, reinforcing ribs 33 bear the thrust and thrust-opposing forces by compression forces, that is, not by bending forces. Furthermore, since reinforcing ribs 33 integrally join bosses 24 having a high rigidity, the rigidity of a rahmen structure including faucet rib 34, reinforcing ribs 33 and bosses 24 is very high.

Figure 6:
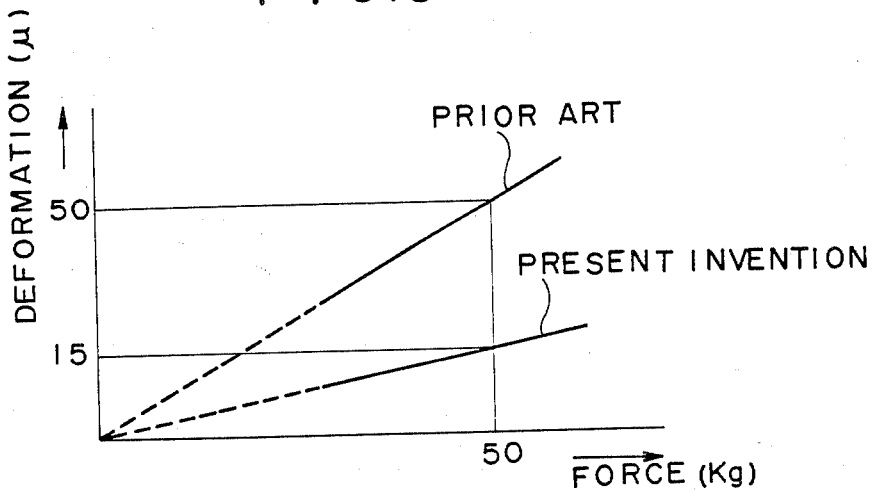
FIG. 6 is a diagram showing a relationship between forces and deformations according to the present invention together with a relationship according to a prior art.
Figure 7:
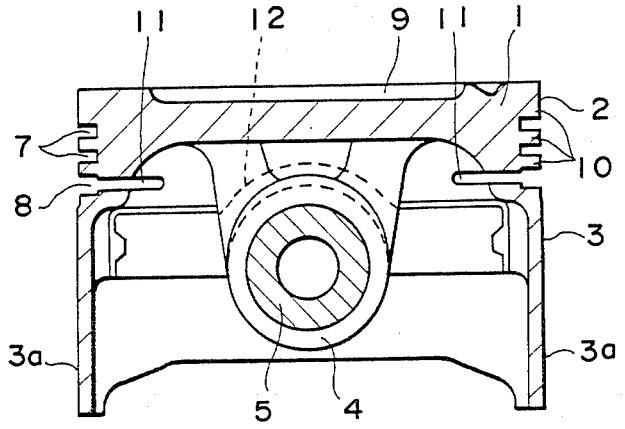
FIG.7 PRIOR ART
FIG. 7 is a sectional view of a piston of a prior art.
Figure 8:
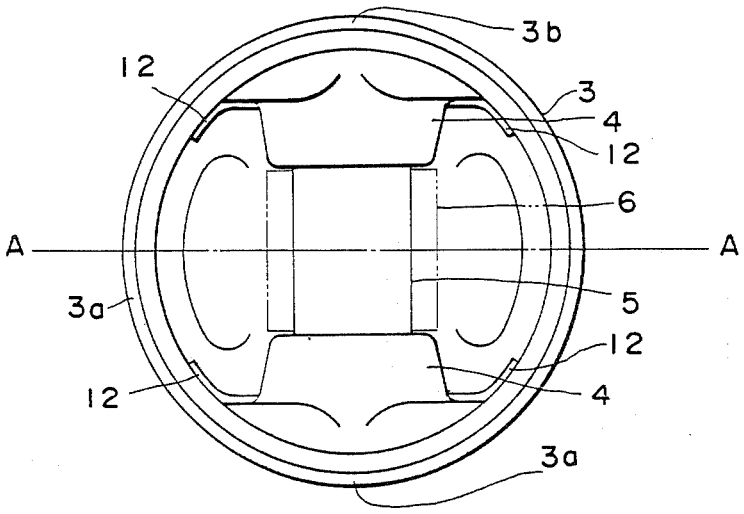
FIG.8 PRIOR ART
FIG. 8 is a bottom view of the piston of FIG. 7.

FIG. 6 show the deformation suppression effects of reinforcing ribs 33 of the present invention together those of a prior art. In piston 1 of a prior art, the forces which were required to produce an elastic deformation of 50 micron in thrust and thrust-opposing sides of skirt 3 of piston 1 were 50 kg, while in piston 21 provided with reinforcing ribs 33, the elastic deformation produced in thrust and thrust-opposing sides 23*a* of skirt 23 of piston 21 when the same forces of 50 kg were imposed on piston 21 in the thrust and thrust-opposing direction of piston 21 was 15 micron. A permanent deformation of about 50 micron becomes a problem. Although the above-mentioned experiment monitored elastic deformations instead of permanent deformations, the experiment is relevant in that repetition of elastic deformations results in permanent deformations. The results of the above tests on the basis of elastic deformations mean that provision of reinforcing ribs 33 will decrease the permanent deformation of thrust and thrust-opposing sides 23*a* of skirt 23 of piston 21 according to the present invention to about one third of the permanent deformation of thrust and thrust-opposing sides 3*a* of skirt 3 of piston 1 according to a prior art.

According to the present invention, since piston 21 is reinforced by reinforcing ribs 23 in the thrust and thrust-opposing direction of piston 21, the permanent deformation of skirt 23 can be decreased to a great extent and slapping sounds of the piston and cylinder structure can be suppressed.

Although only one exemplary embodiment of the present invention has been described in detail above, those skilled in the art will readily appreciate that many modifications are possible in the exemplary embodiment without departing from the novel teachings and advantages of the invention. Accordingly, all such modifications are intended to be included within the scope of the present invention as defined in the following claims.

What is claimed is:

1. A piston for an internal combustion engine comprising:

a crown having a circumferentially extending oil-ring groove in an outer portion of the crown, the oil-ring groove having slits on thrust and thrust-opposing sides of the piston;

a skirt integrally connected to the crown and extending downward, the skirt having a circumferentially extending faucet rib on an inside surface of a lower portion of the skirt;

a pair of opposed bosses protruding inward from an inside surface of the piston and extending in a direction perpendicular with a thrust and thrust-opposing direction of the piston, the bosses being opposed to each other; and reinforcing ribs formed on the inside surface of the piston and protruding inward from the inside surface of the piston, the reinforcing ribs extending straight in a plane extending in the thrust and thrust-opposing direction of the piston from the faucet rib to the bosses, each reinforcing rib being integrally connected to the faucet rib and to a boss.

2. The piston according to claim 1 wherein the lower portion of the skirt is substantially cylindrical and a portion of the skirt excluding the lower portion has a substantially cylindrical inner surface on the thrust and thrust-opposing sides of the piston and has a substantially flat inner surface on sides perpendicular with the thrust and thrust-opposing direction of the piston, the reinforcing ribs being integrally formed on the substantially flat sides.

3. The piston according to claim 1 wherein the reinforcing ribs extend obliquely upward from the faucet rib to the bosses.

4. The piston according to claim 1 wherein the reinforcing ribs are formed on both sides of each of the bosses and are symmetrical to each other with respect to each of the bosses.

5. The piston according to claim 1 wherein upper surfaces and lower surfaces of the reinforcing ribs are connected to a upper surface and a lower surface of the faucet rib, respectively, and the upper surfaces and the lower surfaces of the reinforcing ribs are connected to outside surfaces of lower portions of the bosses.

6. The piston according to claim 2 wherein a height of the reinforcing ribs in a radial direction of the piston is not less than one third of a thickness of the portion of the skirt with the substantially flat sides.

7. The piston according to claim 6 wherein the reinforcing ribs have a substantially constant height and a substantially constant width through an entire length thereof.

8. The piston according to claim 1 further comprising struts disposed in an upper portion of the skirt and extending from one of the thrust and thrust-opposing sides of the piston to the other.

9. The piston according to claim 8 wherein the struts are made of a material having a lower coefficient of thermal expansion than the material of the remainder of the piston.

* * * * *